United States Patent [19]

Linkert et al.

[11] Patent Number: 4,544,407

[45] Date of Patent: Oct. 1, 1985

[54] PROCESS FOR PRODUCING CAST IRON CASTINGS WITH A VERMICULAR GRAPHITE STRUCTURE

[75] Inventors: Reinhold Linkert, Hilzingen, Fed. Rep. of Germany; Emil Becker, Flurlingen; Horst Hoffmann, Schaffhausen, both of Switzerland

[73] Assignee: George Fischer Aktiengesellschaft, Switzerland

[21] Appl. No.: 449,008

[22] PCT Filed: Mar. 30, 1982

[86] PCT No.: PCT/CH82/00050

§ 371 Date: Nov. 29, 1982

§ 102(e) Date: Nov. 29, 1982

[87] PCT Pub. No.: WO82/03410

PCT Pub. Date: Oct. 14, 1982

[30] Foreign Application Priority Data

Mar. 3, 1981 [CH] Switzerland ..... 2158/81

[51] Int. Cl.[4] ..... C22C 33/08

[52] U.S. Cl. ..... 75/130 A; 75/53; 75/58; 75/130 R

[58] Field of Search ..... 75/130 A, 130 R, 58, 75/53

[56] References Cited

U.S. PATENT DOCUMENTS

| | | | |
|---|---|---|---|
| 3,724,829 | 4/1973 | Alt | 266/216 |
| 3,747,912 | 7/1973 | Wernli | 266/216 |
| 3,802,680 | 4/1974 | Anders | 75/53 |
| 3,833,361 | 9/1974 | Kusaka | 75/130 R |
| 3,955,973 | 5/1976 | Robinson | 75/58 |
| 3,998,625 | 12/1976 | Kores | 75/58 |
| 4,094,666 | 6/1978 | Ototani | 75/58 |
| 4,205,981 | 6/1980 | Watmough | 75/58 |

*Primary Examiner*—Peter D. Rosenberg

*Attorney, Agent, or Firm*—Roylance, Abrams, Berdo & Goodman

[57] ABSTRACT

Cast iron with a vermicular graphite structure is produced by a process which involves the steps of determining the ratio of magnesium to sulphur in the melt and then adjusting the value of such ratio to between about 0.8 amd 2.5.

21 Claims, No Drawings

PROCESS FOR PRODUCING CAST IRON CASTINGS WITH A VERMICULAR GRAPHITE STRUCTURE

The invention refers to a process for producing cast iron castings with a vermicular graphite structure.

Cast iron with a vermicular graphite structure (GGV) is a comparatively new material to be listed between grey cast iron (GGL) and spheroidal graphite cast iron (GGG). Due to its mechanical properties such as its tensile strength, toughness and modulus of elasticity as well as because of its heat conductivity, the GGV material is particularly well suited for diesel engine cylinder heads, moulds for steel making plants and turbo-supercharger housings, which means that GGV is normally suited for parts not subjected to shocklike temperature changes. In such applications GGV is superior to GGL. As compared to GGG, GGV has a higher heat conductivity and better pouring technique properties. In particular the decay effect of the magnesium in the treated cast iron melt is less distinct, so that a pouring time even above 20 minutes is possible. In addition thereto, the reduced inclination to shrinkage cavities and better machinability are a further advantage of GGV.

The metal GGV can be produced by a magnesium (Mg) or calcium carbide ($CaC_2$) treatment of the initial melt, after which treatment titanium (Ti) or a cerium metal mixture is being added. A $CaC_2$ desulphurization is e.g. described in the German Patent Specification (DE-PS) 1 911 024 and a titanium addition in the published German Patent Application (DE-OS) 1 533 279.

In DE-OS 2 458 033 an appropriate process has been described, in which an initial melt is being pretreated with magnesium until the sulphur content falls to 0.1 percent, while the lapse of time between the magnesium treatment and the addition of lanthanide series metals is so stipulated, that no nodular graphite is being produced. It is, however, not explained how this lapse of time can be determined. This DE-OS, furthermore, teaches, that a desired creation of vermicular graphite is not possible by means of pure magnesium only.

It is the object of the present invention to remove the disadvantages cited above and to propose a process and an apparatus on the basis of the prior art, for fast, economical and exact production of cast iron with vermicular graphite.

This object is being achieved by means of the features listed in the characterizing portion of claim 1.

Advantageous further developments of the invention have been described in the dependent claims.

Contrary to the opinion in the cited DE-OS 2 458 033 it was found, that the production of GGV is possible by desulphurization by means of pure magnesium.

As compared with calcium carbide desulphurization, desulphurization by pure magnesium has the advantage, that the duration of the desulphurization can be reduced by about 80 percent.

Furthermore, those foundries, which have installed a pure magnesium converter for the production of spheroidal graphite cast iron, possess a great advantage. It is then possible, on a short notice, and if necessary for a short period of time, to change to the production of GGV, which requires only a corresponding weight reduction of the pure magnesium added to the melt. This is in particular interesting for the reason that the demand for GGV is still relatively low, as compared with GGG.

A separate container with a supply device for, e.g. calcium carbide, is not required. Furthermore, addition of titanium is, e.g. because of the created titanium carbide, not recommended, since it is difficult to solve this material. The process according to the invention does not require the harmful addition of titanium.

Initial melts which can be treated by the process according to the invention have the following typical composition.

$3.5 \leqq$ percent carbon $\leqq 4.0$
$2.0 \leqq$ percent silicon $\leqq 3.0$
$0.1 \leqq$ percent magnesium $\leqq 0.6$
$0.02 \leqq$ percent sulphur
Remainder: iron with the usual contaminations.

The treatment with pure magnesium is preferably carried out in a converter for pure magnesium according to DE-PS 18 15 214, 22 16 796 and 22 15 416 at a temperature from 1450° to 1520° C. and gives the following typical analysis:

$3.4 \leqq$ percent carbon $\leqq 4.0$
$2.0 \leqq$ percent silicon $\leqq 3.0$
$0.1 \leqq$ percent Mn $\leqq 0.6$
$0.010 \leqq$ percent magnesium $\leqq 0.025$
$0.005 \leqq$ percent sulphur $\leqq 0.015$
Remainder: iron with the usual contaminations.

A very exact work performance is important. It is necessary that the weight of the melt to be treated, its sulphur content and the weight of the pure magnesium to be added are very exact.

Also, the temperature in the converter should be within tolerance limits of at least $\pm 20°$ C.

Based upon the analysis present after the treatment with pure magnesium, the proportion of Mg:S is adjusted immediately before the beginning of the pouring by addition or pyrite iron or Mg prealloy in the range of 0.8–2.5, preferably of 1.2–2.0. The best results were obtained with a proportion of Mg:S of about 1.8:1. The optimal proportion of Mg:S has to be determined by each foundry and should be checked in regular time intervals.

It has been found that an addition of cerium in the form of a metal mixture and/or of other elements such as Al, Zr, Ca delays the spherolitization during the treatment with pure magnesium and thus widens the range in which CGV is being formed.

Under perfect production conditions (holding back of the treatment slag in the converter, in the transport- and/or casting-ladle, no excessive contact with the oxygen in the air, and protection against too fast cooling), pouring times of more than 20 minutes were achieved in tests made in our own works.

We claim:

1. A process of producing cast iron with a vermicular graphite structure, comprising the steps of:

determining the ratio of Mg to S in the melt; and adjusting the Mg/S ratio of the melt to a value of from about 0.8 to about 2.5.

2. The process of claim 1 wherein the Mg/S ratio is adjusted to a value of from about 1.2 to about 2.0.

3. The process of claim 1 wherein the Mg/S ratio is adjusted to a value of about 1.8.

4. The process of claim 1 wherein the Mg/S ratio is adjusted by adding of pure magnesium to the melt.

5. The process of claim 1 wherein the Mg/S ratio is adjusted by adding a compound comprising nickel and magnesium.

6. The process of claim 1 wherein the Mg/S ratio is adjusted by adding a compound comprising sulphur.

7. The process of claim 6 wherein the compound is pyrite iron.

8. The process of claim 1 wherein the formation of vermicular graphite structure is enhanced by adding a compound comprising cerium, aluminum, zirconium, calcium or mixtures thereof.

9. The process of claim 8 wherein the compound comprises calcium and silicon.

10. The process of claim 1 wherein the formation of a vermicular graphite structure is enhanced by adding a compound comprising a rare earth element.

11. The process of claim 1 wherein the initial melt has a sulphur content of up to about 0.3 percent.

12. The process of claim 11 wherein the process is carried out in a converter.

13. A process of producing cast iron with a vermicular graphite structure, comprising the steps of:

determining the Mg/S ratio in a melt;

adding a sulphur compound when the Mg/S ratio is greater than about 2.5;

adding a magnesium compound when the Mg/S ratio is less than about 0.8; and repeatedly adding the compounds until the Mg/S ratio is within the range of about 0.8 to about 2.5.

14. The process of claim 13 wherein the sulphur compound is iron having a sulphur content.

15. The process of claim 13 wherein the magnesium compound is pure magnesium.

16. The process of claim 13 wherein the magnesium compound is an alloy comprising magnesium and nickel.

17. The process of claim 15 wherein the initial melt has a sulphur content of up to about 0.3 percent; and the process is carried out in a converter.

18. A process for producing cast iron with a vermicular graphite structure in a converter, wherein the initial melt has a sulphur content of up to about 0.3 percent, comprising the steps of:

determining the Mg/S ratio in the melt;

adding a sulphur compound when the Mg/S ratio is greater than about 2.5;

adding a magnesium compound when the Mg/S ratio is less than about 0.8; and repeatedly adding the compounds until the Mg/S ratio is within the range of about 0.8 to about 2.5.

19. The process of claim 18 wherein the sulphur compound is iron having a sulphur content.

20. The process of claim 18 wherein the magnesium compound is pure magnesium.

21. The process of claim 18 wherein the magnesium compound is an alloy comprising magnesium and nickel.

* * * * *